United States Patent [19]

Swisher, Jr.

[11] 4,195,946

[45] Apr. 1, 1980

[54] METHOD FOR RESURFACING A PAVED ROADWAY

[75] Inventor: George W. Swisher, Jr., Oklahoma City, Okla.

[73] Assignee: CMI Corporation, Oklahoma City, Okla.

[21] Appl. No.: 909,228

[22] Filed: May 24, 1978

Related U.S. Application Data

[63] Continuation of Ser. No. 765,869, Feb. 4, 1977, abandoned.

[51] Int. Cl.[2] ..... E01C 23/00

[52] U.S. Cl. ..... 404/75; 299/39; 404/90

[58] Field of Search ..... 404/75, 72, 90, 91, 404/95, 84, 83, 101; 299/39

[56] References Cited

U.S. PATENT DOCUMENTS

| | | | |
|---|---|---|---|
| 1,938,755 | 12/1933 | Swearingen | 404/91 |
| 2,039,026 | 4/1936 | Pease | 404/75 |
| 2,394,017 | 2/1946 | Seaman | 404/91 X |
| 2,817,275 | 12/1957 | Lenker | 299/39 |
| 2,873,541 | 2/1959 | Eliason | 404/84 |
| 3,158,945 | 12/1964 | Curlett | 404/84 X |
| 3,264,958 | 8/1966 | Babb | 404/84 |
| 3,270,632 | 9/1966 | Schultz | 404/77 |
| 3,361,042 | 1/1968 | Cutler | 404/90 X |
| 3,414,327 | 12/1968 | Austin | 299/39 X |
| 3,540,360 | 11/1970 | Snow | 404/84 |
| 3,564,986 | 2/1971 | Burgin | 404/84 |
| 3,566,759 | 3/1971 | Gurries | 404/84 |
| 3,989,364 | 11/1976 | Wirtgen | 299/39 |

FOREIGN PATENT DOCUMENTS

| | | | |
|---|---|---|---|
| 505767 | 4/1976 | U.S.S.R. | 404/95 |

*Primary Examiner*—Nile C. Byers, Jr.
*Attorney, Agent, or Firm*—Dunlap, Codding & McCarthy

[57] ABSTRACT

A method and apparatus for resurfacing an existing paved roadway to produce a new roadway surface having a predetermined grade and cross slope, particularly wherein the existing paved roadway has at least one irregular depression therein extending below the predetermined grade and wherein the portion of the roadway above the predetermined grade is removed in particulate form for use as a recyclable aggregate in resurfacing the roadway.

2 Claims, 18 Drawing Figures

METHOD FOR RESURFACING A PAVED ROADWAY

CROSS REFERENCE TO RELATED APPLICATIONS

This application is a continuation of Ser. No. 765,869 filed Feb. 4, 1977, and now abandoned.

The subject matter of the present patent application is related to the subject matter disclosed in the copending U.S. patent application Ser. No. 672,326, filed Mar. 31, 1976, now U.S. Pat. No. 4,139,318 entitled "A Method And Apparatus For Planning A Paved Roadway", and assigned to the assignee of the present invention.

BACKGROUND OF THE INVENTION

1. Field of the Invention

The present invention relates generally to roadway construction apparatus, and more particularly, but not by way of limitation, to a method and apparatus for resurfacing an existing paved roadway, particularly wherein the existing paved roadway has at least one irregular depression therein extending below a predetermined grade.

2. Description of the Prior Art

A very detailed examination of the state of the art of planers used to resurface existing paved roadways has been made of record in the related U.S. patent application Ser. No. 672,326, filed Mar. 31, 1976 and entitled "A Method And Apparatus For Planing A Paved Roadway", and is therefore incorporated herein by reference to preclude reiteration of this lengthy discussion.

In addition, however, it has been proposed in U.S. Pat. No. 3,843,274, issued to Gutman et al., to provide a vehicle having means for heating the upper layer of asphalt of an existing paved roadway, a rotating cutter for lifting the heated asphalt, a pugmill for pulverizing the lifted asphalt, a spreader for spreading the pulverized asphalt, and a leveler for leveling the distributed asphalt. However, such a vehicle is totally inapplicable to existing concrete roadways. Further, the method and apparatus is ineffecient at best, and often totally ineffective, in a wide variety of commonly occuring environments due to inherent humidity and temperature limitations.

Since it is certainly not uncommon to find irregular depressions or "pot holes" in existing paved roadways, it would not be unreasonable to assume that an existing paved roadway to be resurfaced to provide a new roadway surface having a predetermined grade and cross slope would have at least one irregular depression therein extending below the predetermined grade. Prior to the present invention, the most common mode of "repairing" such a depression would be to fill the depression with a quantity of hot mix asphalt and compact the asphalt either by hand or using compacting rolling machines or the like. However, it has been demonstrated that these "repaired" depressions deteriorate far more rapidly than the surrounding existing paved roadway primarily due to the inability of the current technique to compact the new asphalt material to substantially the same density as the surrounding pavement and also a general inability to induce satisfactory bonding between the new asphalt material and the existing pavement.

SUMMARY OF THE INVENTION

The present invention provides a method and apparatus for resurfacing an existing paved roadway to produce a new roadway surface having a predetermined grade and cross slope, particularly wherein the existing paved roadway has at least one irregular depression therein extending below the predetermined grade, and wherein the portion of the roadway above the predetermined grade is removed in particulate form for use as a recyclable aggregate in the production of new paving material for reapplication to the roadway.

It is a primary object of the present invention to provide a method and apparatus for resurfacing an existing paved roadway to produce a new roadway surface having a predetermined grade and cross slope.

Another object of the present invention is to provide a method and apparatus for resurfacing an existing paved roadway to produce a new roadway surface having a predetermined grade and cross slope, particularly wherein the existing paved roadway has at least one irregular depression therein extending below the predetermined grade.

Yet another object of the present invention is to provide a method for repairing irregular depressions in existing paved roadways, particularly wherein the irregular depression extends below a predetermined grade to be provided during the course of resurfacing an existing paved roadway to produce a new roadway surface having a predetermined grade and cross slope.

Stil another object of the present invention is to provide a method and apparatus for resurfacing an existing paved roadway to produce a new roadway surface having a predetermined grade and cross slope in a manner that permits year-round operation, independent of most weather considerations.

Another object of the present invention is to provide a method and apparatus for resurfacing an existing paved roadway wherein a portion of the roadway lying above a predetermined grade and cross slope is removed in particulate form suitable for reuse as a recyclable aggregate in the production of new paving material.

It is a further object of the present invention to provide a method and apparatus for resurfacing an existing paved roadway to produce a new roadway surface having a predetermined grade and cross slope in a manner which is highly efficient and very effective in operation.

Other objects and advantages of the invention will be evident from the following detailed description when read in conjunction with the accompanying drawings which illustrate various embodiments of the invention.

DESCRIPTION OF FIGS. 1 THROUGH 11

Figure 1:
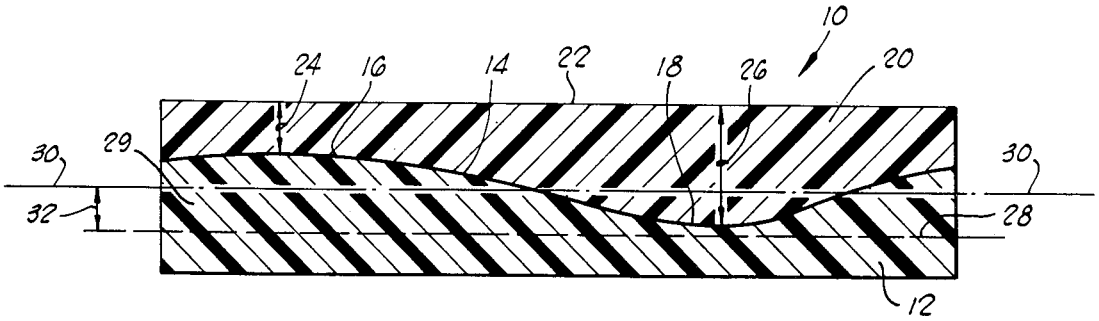
FIG. 1 is a diagrammatical representation of a cross section of a typical paved roadway that has been resurfaced.

Since a detailed description of FIGS. 1 through 11 is contained in the copending U.S. patent application No. 672,326, filed Mar. 31, 1976, now U.S. Pat. No. 4,139,318 entitled "A Method and Apparatus for Planing a Paved Roadway", only such discussion as is necessary to support the present invention will be included herein. Referring to FIG. 1, shown therein is a diagrammatical representation of a cross section of a typical paved roadway 10 that has been resurfaced. The paved roadway 10 has an original base layer of bituminous asphalt 12 that developed through traffic usage, a very rough top surface 14 that has highs and lows therein, a peak 16 and a valley 18 being typical. A typical repair of the paved roadway 10 depicted in FIG. 1 would be to overlay the base layer 12 with a bituminous layer 20, a technique that is well known and practiced widely throughout the road construction industry. The layer 20 (also referred to herein as the old technique layer) would normally be compacted with a bituminous paving roller to obtain a smooth upper surface 22. Of course, it will be appreciated that the layer 20 must have sufficient thickness 24 over the peak 16 to give a strong resurfacing job, and further, that the layer 20 must have a thickness at the valley 18 to give the smooth upper surface 22.

It is well known that the wear of a bituminous layer will be greatly influenced by the uniformity of its substrate. That is, a bituminous layer that is laid over a uniformly even substrate surface will hold up very well in traffic usage. One of the reasons for this is that the layer is capable of receiving uniform compaction in the final rolling operation commonly practiced in the road-building art. On the other hand, when a bituminous layer is laid over a surface like the one depicted by the top surface 14 in FIG. 1, experience has shown that the amount of compaction achieved is not uniform, and that less compaction will occur over the valley 18 than over the peak 16. As the new layer 20 is subjected to traffic, it wll be further compacted by the traffic and the smooth upper surface 22 will be shifted and redistributed. As wear forces continue, the roadway once again will come into a state of disrepair.

The present invention contemplates the use of precision planing wherein a portion of the base layer 12 will be removed prior to the resurfacing of a paved roadway. Thus, the present invention teaches a method and apparatus for selectively removing material from the roadway down to a new roadway surface 28 as indicated by the dashed line. It should be noted that the new roadway surface 28 is shown in a location just below the valley 18, which is a plane of recession selected so as to have some material removed at all points of the old top surface 14. While this is not essential, it is desirable as a more uniformly even new roadway surface is thereby obtained.

Once the new roadway surface 28 has been created by planing the old top surface 14, a uniform layer 29 of bituminous material can be laid to a level indicated by a broken line 30 having a thickness 32 that may be the same as, or less than, the thickness 24 that was needed over the peak 16 by the old paving technique. It is obvious that far less bituminous material will be necessary for the layer 29 (also referred to as the new technique layer) as compared to the amount of material for the old technique layer 20 for the reason that it is no longer necessary to fill the valley 18 in order to cover the peak 16. In fact, the new technique layer 29 can be made significantly thinner than the minimum thickness required of the old technique layer 20. The reason for this is that the thickness 24 of the old technique layer 20 must be adequate to withstand lateral tearing forces incurred with the shifting of the material in the layer 20 during traffic wearing as mentioned above. Since lateral movement is less of a consideration in the new technique layer 29 laid over the uniform new roadway surface 28, the thickness 32 can be reduced to between approximately $\frac{1}{3}$ to approximately $\frac{1}{2}$ of previously used resurfacing layer, with the actual thickness used being dependent upon the traffic requirements of a particular location.

An added benefit of a precision planing operation prior to resurfacing is the lack of buildup of the paved roadway that occurs in the old method of adding successive resurfacing layers. This buildup has become so great in many areas that the pavement has overrun the original curbing, gutters and manhold skirts, leading to the necessity in many such cases of having to extend these items to re ch the increased pavement elevation. In the practice of the present invention, this buildup is avoided as the surface of the new layer can be maintained with a grade and cross slope approximately equal to that of the original pavement, and this can be achieved for each subsequent resurfacing layer laid on a paved roadway throughout the life of the roadway.

Further, the resultant planed surface 28 that is created by the method and apparatus taught herein is a very clear surface, being free of oil and other road films.

The planed surface 28 is a generally smooth, yet textured, surface which provides a very good bonding surface for overlay with concrete, latex concrete or asphalt. In fact, there are many applications in which the planed surface 28 can be used without an overlay, as for example when removing the top portion of a roadway that has received several bituminous layers. Such roads can possibly be planed several times in a repair program designed to lessen the overall thickness of paved material while using the new roadway surface 28 as an intermediate roadway.

While a bituminous roadway has been shown in FIG. 1 to illustrate the present invention, it is not limited to the planing of bituminous material. The invention teaches precision planing, and it relates as well to other types of pavement, such as concrete or the like, as will become clear in the following discussion. When bituminous material is removed by the invention, the removed pavement material can be recycled by heating the removed pavement material and adding it in controlled measure to new bituminous pavement material. Removed concrete, or other such pavement materials, may also find recycle use as aggregate fill material.

Figure 2:
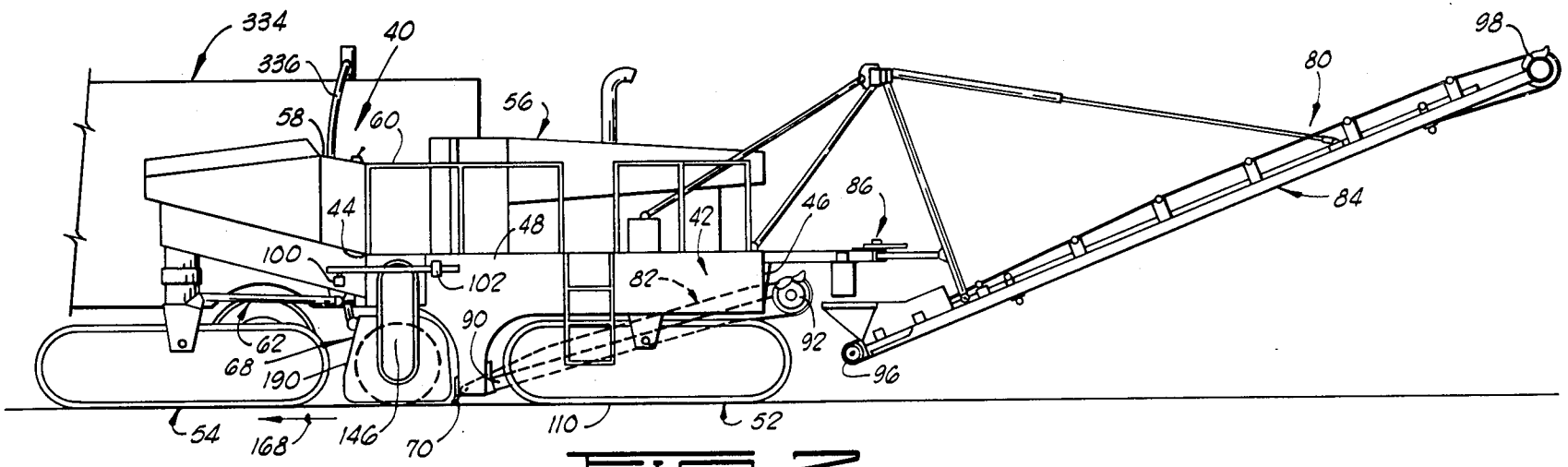
FIG. 2 is a side elevational view of a planar type road construction apparatus.
Figure 3:
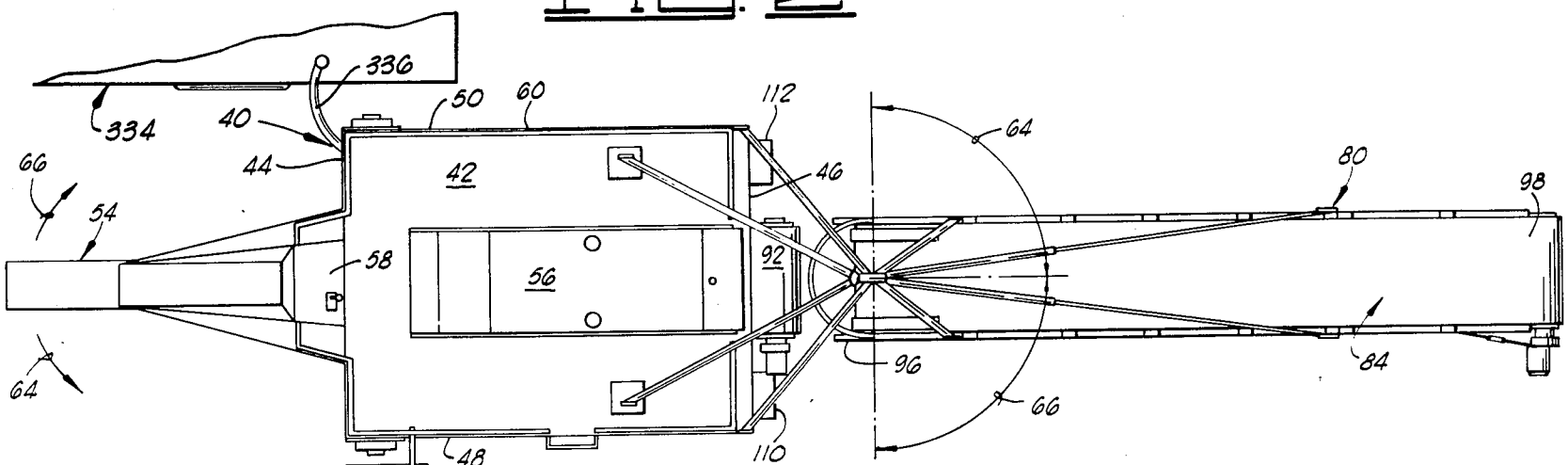
FIG. 3 is a top plan view of the planar apparatus shown in FIG. 2.

Shown in FIGS. 2 and 3 are a planer type road construction apparatus 40 constructed to have many of the features of the present invention. The planer apparatus 40 includes a main frame 42 having a forward end 44, a rearward end 46, a left side 48 and a right side 50. The main frame 42 is supported via a rear drive assembly 52 and a front track assembly 54, the rear drive assembly 52 being drivingly connected to a power drive unit 56 for drivingly moving the main frame 42 during the operation of the planer type road construction apparatus 40. The power drive unit 56 may be of a conventional design such as, for example, a diesel powered engine, and the construction and operation of such a power unit, and the various interconnecting components and operation thereof to drivingly connect the power drive unit 56 to the endless track members, are well known in the art and a detailed description thereof will not be required herein. The major portion of the various manually operated and control actuating elements, which are utilized by an operator to control and operate the planer type road construction apparatus 40, is, in a preferred form, supported in a control console 58. The control console 58 is supported on the main frame 42, generally near the forward end 44 thereof, and a guard-rail type of structure 60 is connected to the main frame 42, as shown in FIGS. 2 and 3.

A steering assembly 62 is connected to the main frame 42 and to a portion of the front track assembly 54 for steering the planer type road construction apparatus 40. More particularly, the steering assembly 62 is constructed to automatically steer the front track assembly 54 in a steering direction 64 and a steering direction 66, as shown in FIG. 3, to steeringly maintain the alignment of the planer type road construction apparatus 40 relative to a control reference, commonly a "string-line", in one aspect of the operation of the planer type road construction apparatus 40.

A planer assembly 68 is supported on the main frame 42, generally near the forward end 44 thereof, and a floating moldboard 70 is also connected to the main frame 42, generally near the planer assembly 68.

A reclaimer assembly 80, which generally includes a base conveyor 82 and an elevated conveyor 84, is supported on the main frame 42 for receiving the removed pavement material removed by the planer assembly 68 for depositing same in a predetermined, controlled, remote location or selected depository. The reclaimer assembly 80 is of the type taught in U.S. Pat. No. 3,946,506, entitled "Trim-Type Road Construction Apparatus With Pivotally Connected Conveyor", assigned to the assignee of the present invention. Therefore, a detailed description of the various components, and the cooperation of those components, of the reclaimer assembly 80 will not be required herein. Rather, it will be sufficient to state that the base conveyor 82 is supported generally between the left side 48 and the right side 50, and extends angularly downwardly from near the rearward end 46 of the main frame 42 to the floating moldboard 70.

As will become clear below, the base conveyor 82 receives removed pavement material at a material receiving end 90 and moves the material toward a material delivery end 92 which is disposed near the rearward end 46 of the planer type road construction apparatus 40. The elevated conveyor 84 has a material receiving end 96 disposed in material receiving relationship to the material delivery end 92 of the base conveyor 82, and the material received therefrom is moved via an endless belt to a material delivery end 98 for depositing the material in a selected position behind the planer type road construction apparatus 40. The general construction details of the base conveyor 82 and the elevated conveyor 84 are provided in U.S. Pat. No. 3,946,506, mentioned above, and the further details are not necessary herein, with the exception that the material receiving end 90 of the base conveyor 82 is supported by the floating moldboard 70 as described below.

The front track assembly 54 and the rear drive assembly 52 are of the type described in U.S. Pat. No. 3,802,525, entitled "Trimmer Type Road Construction Apparatus or the Like", and assigned to the assignee of the present invention. Therefore, it will not be necessary to fully describe the construction details of the front track assembly 54 in the present disclosure. The rear drive assembly 52 comprises a left track assembly 110 connected to the left side 48 of the main frame 42 and a right track assembly 112 connected to the right side 50 of the main frame 42.

The planer apparatus 40 as illustrated herein comprises a planer assembly 68 mounted on a frame that is supported and driven by a three track drive assembly. This illustration is exemplary only, as the present invention is not limited to the drive assemblies 52, 54 described herein for purposes of this disclosure, an important consideration being that when the planer assembly 68 is rigidly fixed to the frame of the propelling machine, which is the preferred embodiment, the frame must be supported in such a manner that the frame may be precisely controlled as to grade and cross slope while the planer assembly 68 is operating.

Preferably, the planer apparatus 40 is automatically actuated in an actuated position thereof in response to an output signal of a track steering sensor that senses the location of an external reference line such as a string-line. Also, the elevation of the main frame 42 relative to the front track assembly 54 and the rear drive 52 is automatically actuated and controlled in an actuated position thereof in response to an elevation sensor that senses the location of an external reference line such as a string-line. A track steering sensor 100 and an elevation sensor 102 are each supportedly connected to the left side 48 of the main frame 42 generally near the forward end 44 thereof. The construction of such sensors and the utilization of sensors such as the track steering sensor 100 and the elevation sensor 102 to provide an output signal responsive to a control reference as well known in the art, such sensors for example being described in U.S. Pat. No. 3,423,859, entitled "Road Construction Methods and Apparatus", assigned to the assignee of the present invention. Furthermore, the application of such sensors and the supporting hydraulic and electrical circuitry to steeringly control the main frame 42 and to raise and lower the main frame 42 relative to the drive assembly (the track assemblies 54, 110 and 112) in an actuated position thereof is described in U.S. Pat. No. 3,802,525, entitled "Trimmer Type Road Construction Apparatus or the Like", assigned to the assignee of the present invention. Therefore, further details of the construction and operation of such sensors are not necessary for purposes of the present disclosure.

Further, in the manner of that described in U.S. Pat. No. 3,802,525, the elevation of one side of the main frame 42 is set in a predetermined elevation setting and the elevation of the other side thereof is automatically controlled via an automatic slope sensor and control apparatus to position the main frame 42 in a predetermined grade and slope position during the operation thereof. Automatic control equipment to establish a predetermined grade and slope of the main frame 42 is also taught in U.S. Pat. No. 3,423,859, cited above. Therefore, a detailed description of such equipment and the cooperation of the components necessary to provide such control is not required herein.

Figure 4:
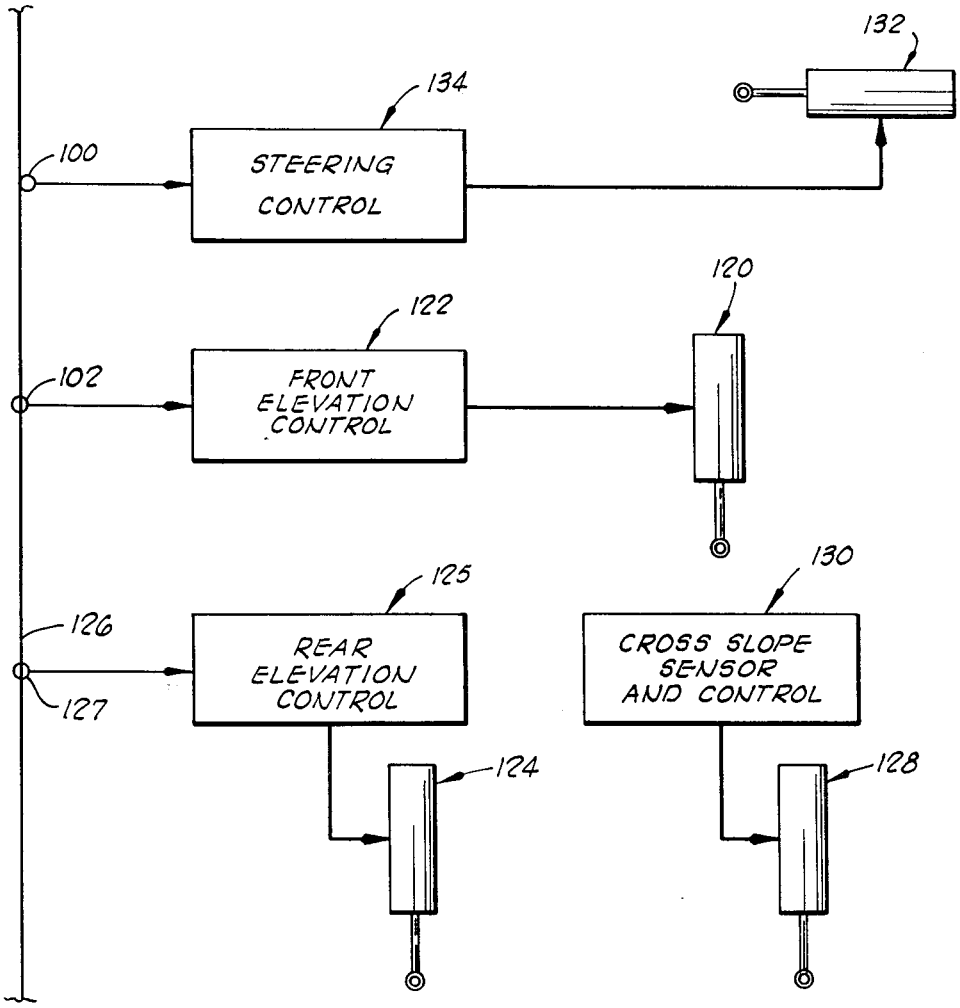
FIG. 4 is a block diagram depiction of the steering, elevation and cross slope control mechanisms of the planar apparatus of FIG. 2.

As stated above, construction details of the control of the steering, elevation and cross slope of the main frame 42 are not required herein as this may be readily obtained from the cited patents. However, it is believed useful to include a discussion of the operation of such equipment by reference to a block diagram as shown in FIG. 4. As shown therein, a double acting front elevation cylinder 120 is shown connected to a front elevation control apparatus 122. Also, a double acting, left rear elevation cylinder 124 is also connected to a rear elevation control apparatus 125. As described in the patents cited above, the front elevation cylinder 120 is connected to the forward end 44 of the main frame 42 and to the front track assembly 54 for the purpose of raising or lowering the forward end 44 when the front elevation cylinder 120 is actuated. In like manner, the left rear elevation cylinder 124 is connected to the left side 48 of the main frame 42 and to the left rear track assembly 110 for the purpose of raising or lowering the left side 48 when the left rear elevation cylinder 124 is actuated. In operation, an external reference line 126 (which may be a string-line or the like) is followed by the elevation sensor 102 and an appropriate control signal is sent thereby to the front elevation control apparatus 122 that in turn sends pressure fluid to extend or retract the cylinder 120 to establish the elevation of the main frame 42 at the forward end 44 at a predetermined elevation.

The left rear elevation cylinder 124 can be extended and established in a setting corresponding to a predetemined grade (known as locked to grade), or the left rear elevation cylinder 124 can be controlled via a rear elevation control apparatus 125. The operation of the rear elevation control apparatus 125 is identical to that which is described above for the front elevation control apparatus 122. That is, an elevation sensor 127 (not shown in FIGS. 2 and 3) follows the external reference line 126 and an appropriate control signal is sent thereby to the rear elevation control apparatus 125 that in turn sends pressure fluid to extend or retract the cylinder 124 to establish the elevation of the left side 48 of the main frame 42 at a predetermined elevation.

The right side 50 of the main frame 42 is controlled by a double acting, right rear elevation cylinder 128 that is connected to the right side 50 of the main frame 42 and to the right track assembly 112 for the purpose of raising or lowering the right side 50 when the right rear elevation cylinder 128 is actuated. A cross slope sensor and control apparatus 130 senses the cross slope of the main frame 42, compares the cross slope of the main frame 42 to a predetermined cross slope value, and actuates the right rear elevation cylinder 128 to maintain the cross slope of the main frame 42 at the predetermined cross slope value.

Also shown in FIG. 4 is a double acting steering cylinder 132 that is connected to the forward end 44 of the main frame 42 and to the front track assembly 54 for the purpose of pivoting the front track assembly 54 relative to the main frame 42. The steering cylinder 132 is actuated by a steering control apparatus 134. The track steering sensor 100 senses the reference line 126 and signals the steering control apparatus 134 that sends pressurized hydraulic fluid to actuate the steering cylinder 132 as required to maintain the desired path of the planer apparatus 40.

The above comments relative to FIG. 4 are illustrative only, as it will be understood that the planar apparatus 40 may be equipped for other modes of operation as well. That is, the track steering sensor 100 and the elevation sensors 102 and 127 may be supported at the right side 50 of the main frame 42, and the reference line 126 disposed along the right side of the planer apparatus 40. The elevation of the main frame 42 would then be achieved by control of the cylinders 120 and 128, while the cross slope would be controlled via the left rear elevation cylinder 124. Also, it is common to equip road construction apparatus such as the planer apparatus 40 with other types of automatic steering equipment and elevation and cross slope actuating equipment that are of known construction, and the details of such equipment are unnecessary herein.

in summation then, the above described steering, elevation and cross slope controls are exemplary only, and it is within the contemplation of the present invention to provide automatic steering controlled from either side of the planar apparatus 40; to provide automatic elevation capability on all suspension points controlled from either side of the planer apparatus 40; and to provide cross slope capability, controlling as necessary, either side of the planer apparatus 40. And although a string reference line 126 is shown, it is contemplated that a conventional ski or grade averaging apparatus can be used to provide a reference line on either side of the planer apparatus 40, with such apparatus being supported on one side of the planer apparatus 40 to give an elevation of a roadway lane or the like that exists alongside of the selected travel of the planer apparatus 40. In this way, the planer apparatus 40 can be controlled to provide precision planing with reference to the grade of an existing surface.

Figure 5:
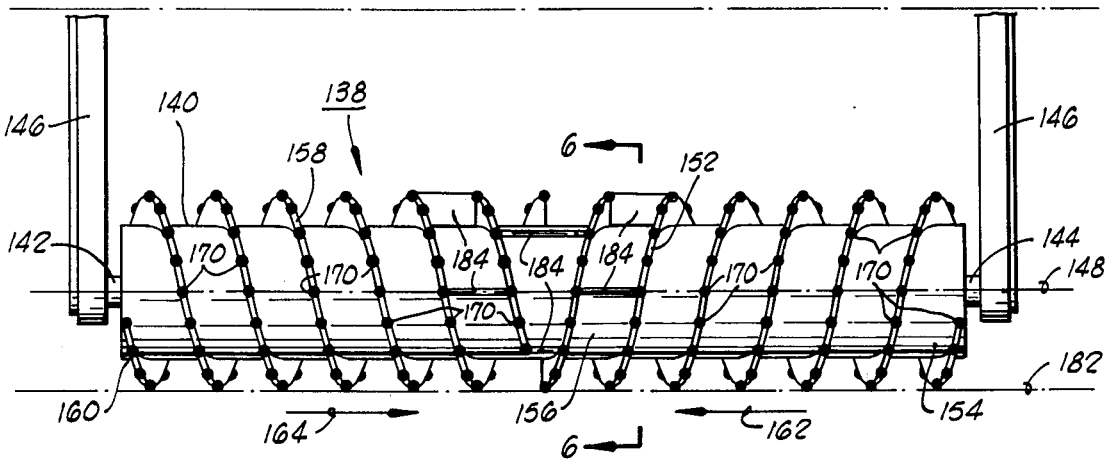
FIG. 5 is a front elevational view in partial detail of the planing cutter of the planer apparatus of FIG. 2.

The planer assembly 68 performs the function of planing the top surface of a paved roadway (such as the top surface 14 of the roadway 10 before being resurfaced) by cutting away a selected portion of the roadway, as discussed above. The planer assembly 68 in the preferred form comprises a planing cutter 138 that comprises a rotary drum 140 as shown in FIG. 5. The drum 140 is rotatably supported under the main frame 42 by way of the trunions 142 and 144 that are journaled in the support members 146 that extend downwardly from the main frame 42. The drum 140 is rotatable about its longitudinal axis 148 by a conventional hydraulic driving assembly (not shown) powered by the power drive unit 56.

Extending about the drum 140 is a spirally winding first flight 152 that begins near the end 154 and terminates near the center portion 156 of the drum 140. Another spirally winding second flight 158 begings near the end 160 and terminates near the center portion 156. The winding pitches of the flights 152 and 158 are opposite to each other and are designed so that the first flight 152 has apparent motion in the first end-to-center direction 162, and the second flight 158 has apparent motion in the second end-to-center direction 164 when the drum is rotated in the rotary direction 166 as viewed in FIG. 6. The planing cutter 138 is preferably rotated in the rotary direction 166 so as to cause the removed portion of the paved roadway 10 to be directed forwardly of the planing cutter 138 and generally moved from the ends 154, 160 in the apparent directions 162, 164 as the main frame 42 is driven in a forward direction 168.

Figure 7:
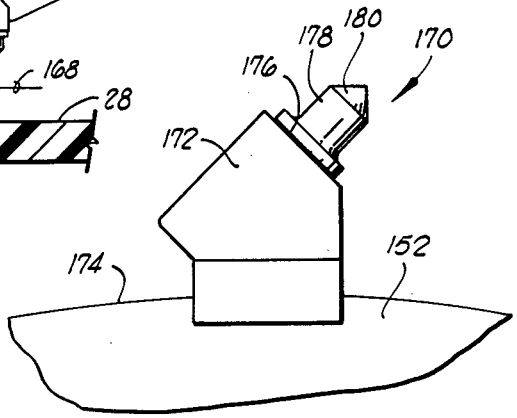
FIG. 7 is a view of one of the cutting heads used on the planing cutter shown in FIG. 5.

Attached along each of the flights 152 and 158 at approximately equal intervals are a plurality of cutting heads 170, a side view of one such cutting head being shown in FIG. 7. The cutting head 170 shown in FIG. 7 comprises a support block 172 which is attached to the outer edge 174 of the first flight 152. The support block 172 has an angled support surface 176 to which is attached a cutter 178, the cutter 178 having a cutting point 180 that is preferably made as an insert of tungsten carbide or the like.

In the preferred form the planing cutter 138 is dimensioned such that the cutting points 180 of all of the cutting heads 170 are disposed equidistantly from the longitudinal axis 148 of the drum 140 so that the cutting points 180 form a uniform plane of cutting that is defined as being the location of the lowest point reached by the cutting points 180 as the planing cutter 138 is rotated. In other words, this cutting plane contains a line 182 that is defined as touching each of the cutting points 180 at their lowest point in the rotation of the planing cutter 138. The line 182 extends transversely to the paved roadway over which the planer apparatus 40 is driven for the reason that the planing cutter 138 is rigidly held by the main frame 42 across the roadway in transverse disposition thereto.

Figure 6:
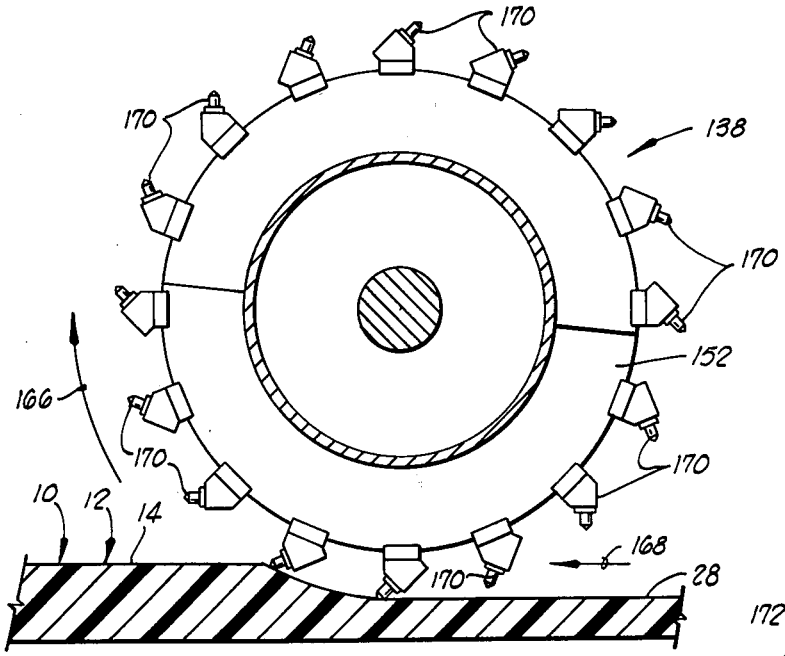
FIG. 6 is a view of the planer cutter taken at 6—6 in FIG. 5.

In FIG. 6, the planing cutter 138 is shown in cutting engagement with the top surface 14 of the paved roadway 10. (The numbered references relative to the roadway in FIG. 6 are used to relate to the depiction shown in FIG. 1.) As the planing cutter 138 is rotated in the rotary direction 166 and moved in the forward direction 168, the new roadway surface 28 is produced. This new roadway surface 28 will be very uniform if the cutting plane of the cutting heads 170 is uniform and coincident with the new roadway surface 28.

Referring to FIG. 5, it should be noted that a number of laterally extending paddle bars 184 are attached to the flights 152 and 158 at spaced intervals about the drum 140 near the center portion 156. The paddle bars 184 are recessed from the cutting heads 170 and serve in the fashion of scoops to throw the removed paving material cuttings upwardly to generally follow the drum 140 in the rotary direction 166. The purpose of this will become clear below.

Figure 8:
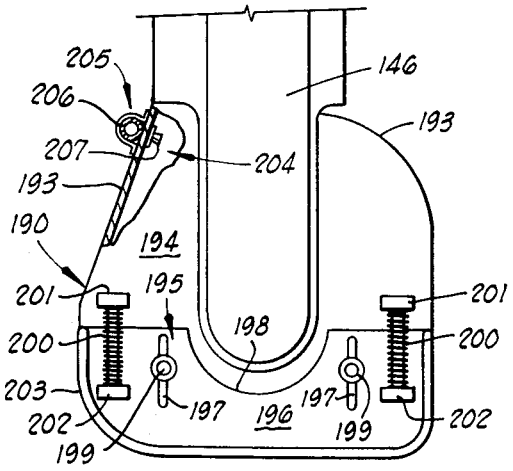
FIG. 8 is a side elevational view showing the hood and one of the end shield members.

Continuing with a description of the planer assembly 68, it will be noted by reference to FIG. 2 that a hood 190, supported by conventional means on the main frame 42, is provided to partially surround the planing cutter 138 in the manner more clearly depicted by FIG. 8.

The hood 190 comprises an arcuately shaped member 193 that is supported by the main frame 42 via conventional bolting means to form a cover substantially forwardly, rearwardly and over the planing cutter 138, excepting the lower portion of the planing cutter 138 for exposure of the planing cutter 138 to cuttingly engage a paved roadway surface. An end panel 194 is attached to the member 193 at each end thereof for partially enclosing the planing cutter 138. Also, each end of the hood 190 is equipped with a sliding shield member 195, one of which is viewed in FIG. 8. The shield member 195 comprises a plate member 196 having a pair of slots 197 and an arbor clearing cutout 198. The shield member 195 is slidably supported on the end panel 194 via bolts 199 that extend through the slots 197. A pair of spring members 200 are compressingly supported between the lugs 201, extensive from the end panel 194, and the lugs 202, extensive from the plate member 196. An arcuately shaped runner member 203 is attached to the plate member 196 and serves as the pavement contacting edge of the shield member 195. As the planer assembly 68 is passed in cutting engagement with a pavement surface, the shield members 195 are biased downwardly via the springs 200 to yieldingly close the lower ends of the hood 190 to retain the removed pavement material generally within the confines of the hood 190 for removal thereof via the floating moldboard 70 and the reclaimer assembly 80 as described more fully below.

In the manner described above, the hood 190 forms a material directing compartment 204 generally over the planing cutter 138. As the planing cutter 138 is rotated, the cutting heads 170 remove a selected top portion of the paved roadway 10, and the removed pavement material is directed upwardly into the material directing compartment 204. The lifting action imparted to the removed pavement material by the velocity of the cutting heads 170 is assisted by the movement of the flights 152 and 158 that tend to move the removed pavement material from the ends 154, 160 of the drum 140 toward the center portion 156 thereof. Further, the paddle bars 184 rotating about the drum 140 tend to scoop and impart lifting action to the removed pavement material near the center portion 156.

In order to minimize the effects of airborne dust and debris, a spray assembly 205 is provided that comprises a supply header 206 that is supported on the hood 190. A plurality of spray nozzles 207 are connected at intervals along the header 206 and are extensive through appropriately located ports into the material directing compartment 204. A supply tank and pump (not shown) are supported by the main frame 42, and a liquid such as water is carried in the supply tank. As this liquid is pumped to the supply header 206, a vapor mist is formed by the spray nozzles 207 in the material directing compartment 204. The effect of the vapor mist is to coalesce the airborne dust and debris, and serves to keep the mass of removed pavement material together as a body. The net result of this spraying is that the cutting action of the planer assembly 68 is practically dustless.

Figure 9:
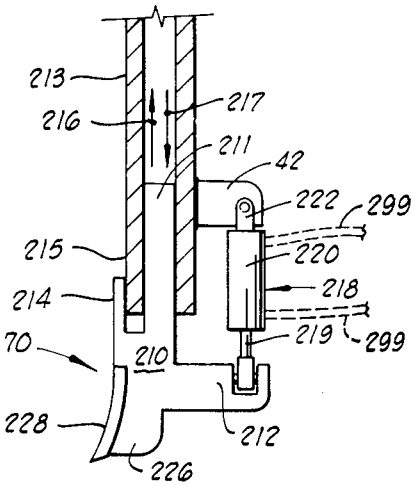
FIG. 9 is a side elevational view in partial cutaway depiction of the floating moldboard of the planer apparatus shown in FIG. 2.

The floating moldboard 70 is disposed just rearwardly of the planing cutter 138, and a semi-detailed view of the moldboard 70 is shown in FIG. 9. The moldboard 70 is a longitudinal member that is approximately the same length as the drum 140, and comprises a body portion 210 that has a pair of generally upwardly protruding guide members 211 and a pair of rearwardly extending members 212, one of each of the guide members 211 and the extending members 212 being disposed near the opposite ends of the floating moldboard 70. The side view shown in FIG. 9 shows one each of the guide members 211 and the extending members 212. For each of the extending members 212 there is provided a hollow member 213 extensive downwardly from the underside of the main frame 42. The cross sectional shape of the extending member 212 is approximately rectangular and is dimensioned to be freely slidable in the hollow core of its respective member 213. A lip portion 214 extends upwardly from the body portion 210 along an outer surface 215 of the member 213 to assist in maintaining the free-sliding action of the floating moldboard 70 in the upward direction 216 and in the downward direction 217.

A pair of hydraulic cylinders 218 are provided, one each connected to each of the rearwardly extending members 212 as shown in FIG. 9. The hydraulic cylinder 218 shown therein has a retractable rod member 219 that is connected via conventional bolting means to the member 212, and a cylinder portion 220 that is bolted via the connector 222 to the main frame 42. The hydraulic cylinder 218 is connected to a conventional source of pressurized fluid via conduits (not shown) and the rod member 219 is yieldingly forced in the downward direction 217.

The moldboard 70 further comprises a heel portion 226 that is pressed by the biasing action of the hydraulic cylinders 218 into sliding contact with the new roadway surface 28 formed by the cutting action of the planer assembly 68. A molding panel 228 is attached to and forms the leading surface of the heel portion 226. The floating moldboard 70 is carried by the main frame 42 behind the planer assembly 68, and together with the reclaimer assembly 80 described above, serves to clear the roadway of the removed pavement material.

Figure 10:
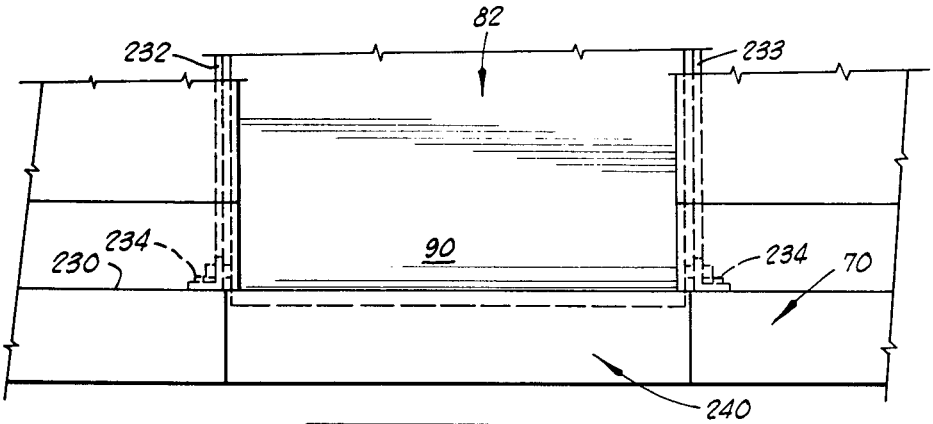
FIG. 10 is a partial plan view showing the attachment of the base elevator to the floating moldboard in the planer apparatus of FIG. 2.

As was mentioned above, it is desirable to have the material receiving end 90 of the base conveyor 82 in close proximity to the floating moldboard 70. This is achieved as shown in FIG. 10 by pivotally and supportingly connecting the material receiving end 90 of the base conveyor 82 to the back side 230 of the floating moldboard 70. This may be achieved by attaching the side frame members 232 and 233 of the base conveyor 82 via conventional bolting means 234. The base conveyor 82 is also supported via pivoting hangers (not shown) to the main frame 42, permitting the material receiving end 90 to follow the upward and downward movement of the floating moldboard 70.

A passageway 240 is disposed in the body portion 210 of the floating moldboard 70 to facilitate the passage of removed pavement material from the material directing compartment 204 to the base conveyor 82. Appropriately shaped directing shields (not shown) may be provided to assist the flow of the removed pavement material onto the base conveyor 82, and the use of conventional flexible sealing flaps (not shown) is suggested to prevent spillage of the removed pavement material onto the new pavement surface 28 in back of the floating moldboard 70.

OPERATION OF THE EMBODIMENT SHOWN IN FIGS. 1 THROUGH 11

In operation, the planer apparatus 40 is placed over the roadway so as to transverse the pavement with the planing cutter 138 at a predetermined grade as established via a string-line or the like. The planer apparatus 40 would then be driven down the paved roadway alongside the string-line, utilizing the steering control 134 in conjunction with the track steering sensor 100 engaging the string-line. The elevation of the main frame 42 would be maintained utilizing the elevation control 122 in conjunction with the elevation sensor 102 engaging the string-line. Also, the main frame 42 would be maintained at a predetermined cross slope via the cross slope sensor and cotrol apparatus 130. Since the planer assembly 68 is rigidly secured under the main frame 42, the planing cutter 138 will cut along a cutting plane extending transversely to the paved roadway 10 as the plural cutting heads 170 cut along the line 182 that extends transversely to the paved roadway 10.

As the plane of cutting is established via the means described above for establishing the grade and cross slope of the main frame 42 at predetermined values thereof, the result will be a uniform cutting action of the top surface of the roadway, exposing a uniform new roadway surface 28 as depicted in FIG. 1. The rotation of the planing cutter 138 is preferably in the rotating direction 166 as shown in FIG. 6 since cutting up against the grain of the paved roadway causes faults such as undetected cracks and weak portions to be most evident. While the planing cutter 138 could be established to rotate in a counter direction to the rotary direction 166, the cutting action as illustrated in FIG. 6 reduces the impact force on the pavement since the cutters cut through and clear of the removed material, while in reverse cutting the cutters enter the roadway and continue through the pavement under the weight of the planing cutter 138.

Another benefit of rotating the planing cutter 138 in the rotating direction 166 is that a pile of the removed pavement material is continuously caused to form in the forward path of the travel of the planing cutter 138 along the roadway. This removed pavement material is dampened by the vapor mist that is sprayed by the spray assembly 205, and the removed pavement material that continuously piles immediately in front of the planing cutter 138 serves to contain the dust created by the cutting action of the cutting heads 170, and to partially muffle the sound of the cutting. And although the removed pavement material is continuously removed via the lifting action described above, there is usually sufficient piling of the removed pavement material to give this beneficial dust containing and sound muffling function.

As the top portion of the roadway is removed in the manner described above, it has been determined that the removed portion of a bituminous roadway will be removed in relatively small pieces which are readily moved toward the center portion 156 of the drum 140 by the action of the flights 152 and 158, and that the rotating action of the paddle bars 184 will generally lift the cuttings of the removed pavement material up and over the planing cutter 138 to be received through the passageway 240 onto the material receiving end 90 of the base conveyor 82, and of course removed in a manner described above for the reclaiming assembly 80. The floating moldboard 70 serves to push any remaining cuttings in front thereof to the point that these overflow the moldboard via the passageway 240 or are slung around in front of the planing cutter 138 by the action of the flights 152 and 158. In practice, the combined action of the planing cutter 138 and the floating moldboard 70 has provided a very satisfactory clearing of the new pavement surface 28 and the placement of the cuttings of the new portion onto the reclaimer assembly 80 thereby.

Figure 11:
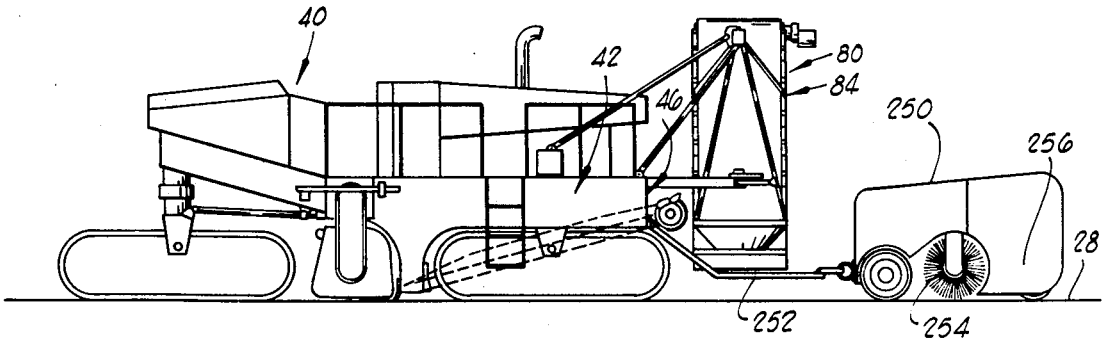
FIG. 11 is a side elevational view of a planer apparatus of the type shown in FIG. 2 and having a sweeper assembly attached thereto.

In most applications of the planer apparatus 40, the newly created surface will be sufficiently cleared of the cuttings of the removed roadway material in the manner described above. However, it is contemplated that there will be some applications in which it is desirable to sweep the new roadway surface following the path of the planer apparatus 40 to remove fine dust and debris not collected by the planer apparatus 40. This can be achieved by a following sweeper apparatus of the type shown in FIG. 11, wherein a sweeper assembly 250 is pulled behind the planer apparatus 40 via an extension bar 252 connected to the rearward end 46 of the main frame 42. The sweeper assembly 250 is conventional in design, and there are a large number of such sweepers available commercially, each having a sweeper 254 and a depository 256 cooperatively sweeping and retaining the dust and debris left on the new pavement surface 28 following the passage of the planer apparatus 40. Of course, a sweeper assembly performing the function of the sweeper assembly 250 could be mounted under the main frame 42, but the preferred embodiment is that as shown in FIG. 11 wherein the sweeper assembly 250 may be disengaged when not required.

DESCRIPTION OF FIGS. 12 THROUGH 14

Figure 12:
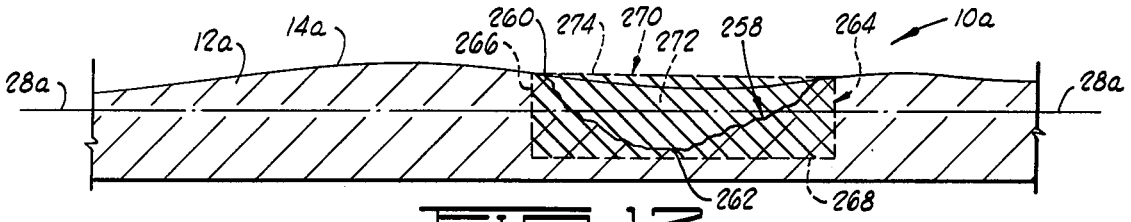
FIG. 12 is a diagrammatical representation of a cross section of a typical paved roadway illustrating the method of the present invention for repairing irregular depressions.

Referring to FIG. 12, shown therein is a diagrammatical representation of a cross section of a typical paved roadway 10*a* having at least one irregular depression 258 therein, and illustrating the method of the present invention for repairing such depressions 258. More particularly, the depression 258 extends not only through the old roadway surface 14*a* but also below a desired new roadway surface 28*a* having a predetermined grade and cross slope established as described generally above. According to the present invention, the first step in repairing the depression 258 is to remove the portion of the existing paving material 12*a* of the paved roadway 10*a* within a predetermined distance of the outer periphery 260 of the depression 258, down to a predetermined depth below the bottom 262 of the depression 258. In other words, the existing paving material 12*a* of the paved roadway 10*a* should be removed from around the periphery 260 and below the bottom 262 of the irregular depression 258 so as to form a generally regular depression 264 having substantially vertical sidewalls 266 and a relatively flat bottom 268. In accomplishing the removal of the portion of the existing paving material 12*a* surrounding and underlaying the irregular depression 258, various well known apparatus may be employed such as that shown and described in U.S. Pat. No. 3,333,646, entitled "Mobile Hammer Unit and Position Control Apparatus Therefor", assigned to the Assignee of the present application.

Following the removal of the desired portion of the material 12*a* to form the regular depression 268, a substantially uniform layer 270 of new pavement material 272, such as hot mix asphalt, should be applied with the regular depression 264, the layer 270 having an upper surface 274 above the predetermined grade and a density substantially the same as the density of the existing pavement materials 12*a* surrounding the regular depression 264. Although other apparatus may be as satisfactory in compressing the new pavement material 272 to the desired density, it has been determined that the apparatus described in U.S. Pat. No. 3,333,646, is particularly well adapted to accomplish this step in view of the ability of this apparatus to precisely control the compression force and stroke length of the compression tool mounted thereon. In this regard, the substantially vertical sidewalls 266 and relatively flat bottom 268 of the regular depression 264 contributes substantially to the success of the present method in obtaining a density within the layer 270 approximating the density of the surrounding existing pavement material 12*a*, in addition to facilitating the bonding of the layer 270 to the existing pavement material 12*a*.

After the layer 270 has been afforded sufficient opportunity to reach an equilibrium condition relative to the surrounding existing pavement material 12*a*, all of the material of the paved roadway 10*a* lying above the predetermined grade and cross slope may be removed by passing a rotating planing cutter, such as that referred to above as the planing cutter 138, over the paved roadway 10*a* at the predetermined grade and cross slope via a planer type road construction apparatus, such as that referred to above as the planer type road construction apparatus 40.

Figure 13:
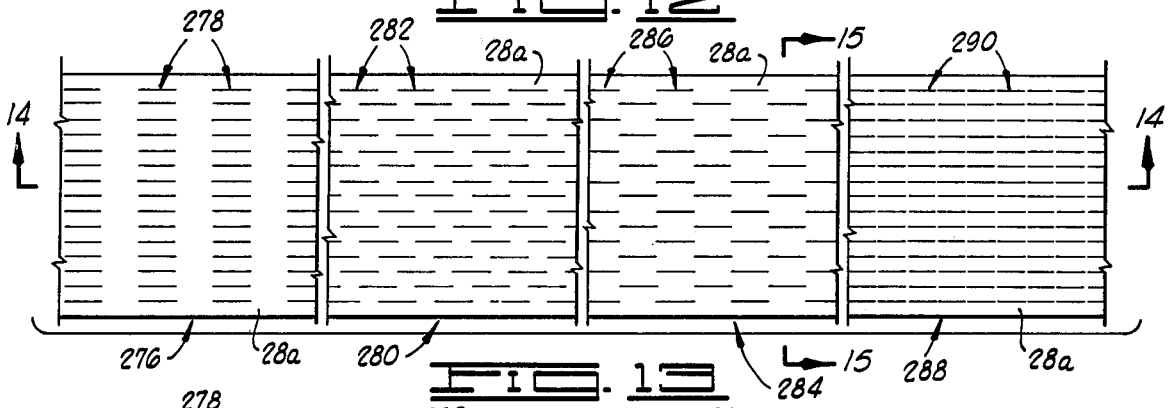
FIG. 13 is a top plan view of paved roadway sections illustrating typical patterns formed therein in the resurfacing thereof according to the present invention.
Figure 14:
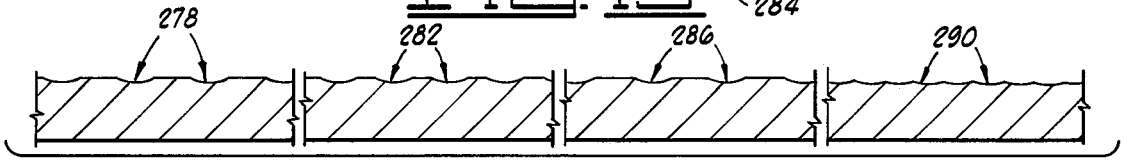
FIG. 14 is a longitudinal cross sectional view of the paved roadway sections shown in FIG. 13 taken along the line 14—14.

During the course of resurfacing the paved roadway 10*a* to produce the new roadway surface 28*a*, it will be readily recognized that the passage of the cutting heads 170 through the pavement material 12*a* will impart an identifiable pattern on the new roadway surface 28*a*. As will be clear to those skilled in the art, the particular pattern impressed upon a given roadway surface 28*a* will be highly dependent upon the spacing and positioning of the cutting heads 170 on the surface of the rotating planing cutter 138, in conjunction with the rotational speed of the planing cutter 138 and the forward velocity of the planer apparatus 40. For example, four distinctive patterns are shown by way of example in FIGS. 13 and 14. In a first pattern, which may conveniently be designated as a full spaced pattern 276, passage of the cutting heads 170 are coordinated so that the paths 278 created thereby are laterally aligned, with longitudinally successive rows of paths 278 being longitudinally spaced on the order of one full length of the paths 278. This full spaced pattern 276 provides generally adequate surface adhesion qualities but induces particularly annoying vibrations in vehicles passing at significant velocities thereover.

In a second pattern, which may conveniently be referred to as a staggered pattern 280, the passage of each transversely successive cutting head 170 is coordinated so that the paths 282 created thereby are longitudinally offset from the laterally adjacent cutting paths 282 on the order of ½ the length of the path. Such a staggered pattern 280 produces a significantly higher rate of wear of the cutting heads 170, while satisfactorily eliminating the irritating vibrational patterns inherent in the full spaced pattern 276. It has been determined that the staggered pattern 280 is particularly advantageous in the resurfacing of concrete roadways due to the excellent surface adhesion qualities inherent therein.

Figure 16:
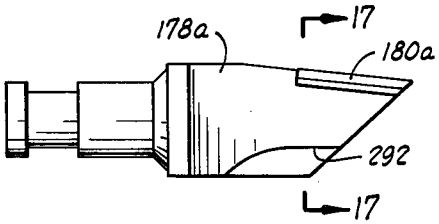
FIG. 16 is a side view of a cutting head particularly suitable for use with the present invention for resurfacing asphalt roadways.
Figure 17:
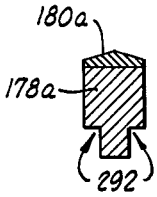
FIG. 17 is a transverse cross sectional view of the cutting head shown in FIG. 16 taken along the line 17—17.

In a third pattern, which may conveniently be referred to as a full offset pattern 284, the passage of each transversely successive cutting head 170 is coordinated so that the cutting paths 286 created thereby are longitudinally offset from the laterally adjacent paths 286 on the order of one full length of each path 286. The production of the full offset pattern 284 induces a rate of wear of the cutting heads 170 substantially the same as the rate of wear induced in the production of the full spaced pattern 276, but satisfactorily elimates substantially all of the undesirable vibrational tendencies of the full spaced pattern 276. It has been determined that the full offset pattern 284 is particularly desirable in the resurfacing of asphalt roadways, especially where the cutting heads 170 are constructed similar to that shown in FIG. 16 and described in detail below.

In a fourth pattern, which may conveniently be referred to as a continuous pattern 288, the passage of the cutting heads 170 are coordinated so that the paths 290 created thereby are laterally aligned, with longitudinally successive rows of paths 290 being at most only slightly longitudinally offset from the adjacent rows of paths 290. The production of the continuous pattern 288 produces a particularly high rate of wear of the cutting heads 170 with the resulting surface exhibiting little if any advantage over the previously described patterns 276, 280 and 284. However, the continuous pattern 288 respresents a particularly smooth traveling surface and may be desired in certain situations.

DESCRIPTION OF FIGS. 15 THROUGH 17

It has been determined through extensive operational utilization of machines constructed similar to the planer type road construction apparatus 40, that cutting heads 170 of the type shown in FIG. 7 are particularly advantageous when resurfacing paved roadways 10 of the concrete type. However, when the cutting heads 170 are utilized to resurface a paved roadway 10 of the asphalt type, there is normally a significantly higher rate of wear of the metal comprising the cutter 178 relative to the rate of wear of the metal forming the cutting point 180, with the effect of "washing" away the cutter 178 leaving the cutting point 180 relatively unsupported. It is therefore proposed to provide an improved cutter **178*a* for use in resurfacing asphalt roadways, wherein the cutter 178*a* is provided with a chisel-like cutting point 180*a* defining the leading face of the cutter 178*a*. Preferably, the cutter 178*a* is provided with scallops 292 on either side thereof relatively rearwardly of the cutting point 180*a* so as to maximize the support being provided the cutting point 180*a* while minimizing the amount of surface area being subjected to the "washing" action experienced during utilization of the cutter 178*a***.

Figure 15:
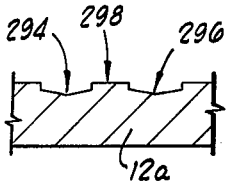
FIG. 15 is a partial, transverse cross sectional view of one of the paved roadway sections shown in FIG. 13 taken along the line 15—15.

In operation, the improved cutter **178*a* will impart a substantially rectangular groove to the pavement being resurfaced. For example, shown in FIG. 15, is a partial, transverse cross sectional view of the full offset pattern 284 as it would appear if produced via the improved cutter 178*a*. Thus, the laterally alternate, substantially rectangular grooves 294 and 296 are separated by a ridge 298 formed by the cooperation of intermediate cutters 178*a*, the associated flights 152 or 158, and the molding panel 228 forming the leading surface of the moldboard 70**.

It has been determined that the "floating" characteristic of the floating moldboard 70 may be undesirable when the improved cutter **178*a* is being used to produce the full offset pattern 284 due to the tendency of the floating moldboard 70 to "ride up" on the ridges 298 rather than "cutting through" them. To remedy this situation, it is proposed to operate the moldboard 70 in a fixed mode by connecting each of the hydraulic cylinders 218 (see FIG. 6) into the hydraulic control circuitry of the planer assembly 40 via hydraulic conduits 299. In this mode of operation, the hydraulic cylinders 218 may be actuated in a double acting manner to fix the position of the moldboard 70, and particularly the lower edge of the molding panel 228, at a second predetermined grade slightly above the predetermined grade selected for the planer assembly 68, to facilitate removal of the material of the paved roadway 10 above the second predetermined grade and the predetermined cross slope. Since the "fixed" moldboard 70 is still being maintained at the same selected cross slope, the tops of the ridges 298 formed by the passage of the moldboard 70 are all at substantially the same elevation relative to the bottoms of the grooves 294 and 296. Of course, if desired, the "fixed" moldboard 70 may be positioned at the same predetermined grade as the planer assembly 68 so as to remove all of the material of the paved roadway 10 above the predetermined grade and cross slope and leave no identifiable ridges 298**.

DESCRIPTION OF THE PREFERRED EMBODIMENT

Figure 18:
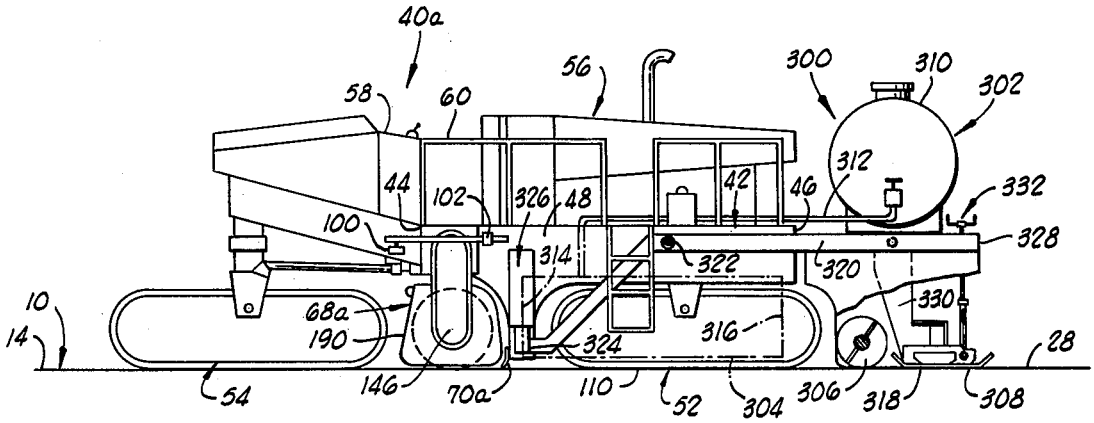
FIG. 18 is a side elevational view of a planer apparatus constructed in accordance with the preferred embodiment of the present invention.

Shown in FIG. 18 is a planer type road construction apparatus **40*a* constructed in accordance with the preferred embodiment of the present invention for resurfacing an existing paved roadway 10 as the planer apparatus 40*a* is driven forwardly over the roadway 10. More particularly, the planer apparatus 40*a* is constructed substantially the same as the planer apparatus 40 described above, except that the planer apparatus 40*a* is provided with an asphalt paving assembly 300 in place of the reclaimer assembly 80**.

The planer apparatus **40*a* includes a planer assembly 68*a* which is substantially the same as the planer assembly 68 described above, i.e. the planer assembly 68*a* is connected to and supported by the planer apparatus 40*a* transversely to the paved roadway 10 at a predetermined grade and cross slope. Thus, the planer assembly 68*a* cuts the paved roadway 10 along a cutting plane having the predetermined grade and cross slope to remove the portion of the roadway 10 above the cutting plane in particulate form suitable for use as a recyclable aggregate. In addition, the planer apparatus 40*a* is provided with a floating moldboard 70*a* which is substantially the same as the floating moldboard 70, with the floating moldboard 70*a* acting to channel and lift the recyclable aggregate produced by the planer assembly 68*a* for introduction to the asphalt paving assembly 300**.

The asphalt paving assembly 300 is comprised primarily of an asphalt supply assembly 302, a mixer 304, a spreader 306, and a screed 308. The asphalt supply assembly 302 consists of a reservoir 310 disposed adjacent the rearward end **46*a* of the planar apparatus 40, and a supply conduit 312 connected between the reservoir 310 and the mixer 304. While the reservoir 310 may in some embodiments be constructed to supply conventional heated asphaltic composition, in the preferred embodiment the reservoir 310** provides an asphaltic emulsion prepared in a conventional manner to effectively react with the recyclable aggregate.

The mixer 304, which is preferably of the pug mill type, has a forward end 314 disposed adjacent the floating moldboard **70*a* for receiving the recyclable aggregate from the floating moldboard 70*a*. The mixer 304 has at least one rotating paddle assembly (not shown) for mixing the recyclable aggregate with a predetermined quantity of the asphaltic composition injected thereinto from the reservoir 310 via the supply conduit 312 to produce new paving material for discharge through a rearward end 316** thereof.

The spreader 306 is connected to the planer apparatus 40*a* immediately rearwardly of the mixer 304 for spreading the new paving material discharged from the mixer 304 across the paved roadway 10 above the cutting plane. The spreader 306 is preferably of the screw conveyor type taught in U.S. Pat. No. 3,997,277, entitled "Material Transfer Mechanism" assigned to the Assignee of the present invention. Therefore, a detailed description of the various components of the spreader 306 will not be included herein.

The screed 308 is connected to the planer apparatus 40*a* immediately rearwardly of the spreader 306 with the lower surface 318 of the screed 308 being maintained at a second predetermined grade and cross slope, the second predetermined grade being substantially parallel to but spaced above the predetermined grade described above as defining the cutting plane. The screed 308 is constructed in a conventional manner to compact the new paving material on the paved roadway 10 to produce a new roadway surface 28 having the second predetermined grade and cross slope. The screed 308 is preferably of the type taught in U.S. Pat. No. 3,997,277, referred to above, and thus will not be described in detail herein.

Although the spreader 306 and the screed 308 may be connected as an integral part of the planer apparatus 40*a*, it has been determined that a more satisfactory construction is to connect at least the screed 308 and preferably the spreader 306 to the planer apparatus 40*a* via a pair of conventional tow bars 320 (only one of which is shown for convenience). In particular, each of the tow bars 320 is pivotally connected at a medial portion thereof to a rearward portion of the main frame 48 of the planer apparatus 40*a* via fixed pivots 322, while the forward ends 324 of the tow bars 320 are each vertically adjustable via a conventional hydraulic cylinder 326 connected between the planer apparatus 40*a* adjacent the floating moldboards 70*a* and the forward ends 324 of the tow bars 320. The screed 308 may then be pivotally connected to the tow bars 320 adjacent the rearward ends 328 thereof via riser members 330, with crank assemblies 332 extending between the screed 308 and the rearward ends 328 of the tow bars 320 to adjust the angle of inclination of the screed 308. Thus, the grade and cross slope of the screed 308 may be adjusted substantially independently of the grade and cross slope of the main frame 48 via the cylinders 326. The construction of the tow bars 320 and the connection thereof between the planer apparatus 40*a* and the screed 308 is taught in U.S. Pat. No. 3,997,277, referred to above.

OPERATION OF THE PREFERRED EMBODIMENT

The planer type road construction apparatus 40*a* will operate substantially the same as the planer type road construction apparatus 40 described in detail above. However, instead of removing the material cut from the old roadway surface 14 the planer apparatus 40*a* utilizes the material as recyclable aggregate in the preparation of new paving material which may be reapplied to produce a new roadway surface 28. In particular, as the planer apparatus 40*a* is driven forwardly over the roadway 10, the planer assembly 68*a* will cut the paved roadway 10 along the predetermined cutting plane to remove the portion of the roadway 10 above the cutting plane in particulate form suitable for use as a recyclable aggregate. The recyclable aggregate will then be introduced into the mixer 304 via the floating moldboard 70*a*, the mixer 304 mixing the recyclable aggregate with a predetermined quantity of asphaltic composition provided by the asphalt supply assembly 302 to produce new paving material.

Upon the discharge of the new paving material onto the roadway 10 by the mixer 304, the spreader 306 will spread the new paving material across the paved roadway 10 generally above the cutting plane. Thereafter, the screed 308 will compact the new paving material on the paved roadway 10 to produce a new roadway surface 28 having a predetermined grade and cross slope related in a known way to the cutting plane.

DESCRIPTION OF AN ALTERNATE EMBODIMENT

As an alternative to providing the asphalt paving assembly 300 in place of the reclaimer assembly 80, it may be desirable in some circumstances to utilize the spray assembly 205, which is supported by the main frame 42 adjacent to and forwardly of the planer assembly 68, as a means for applying the asphaltic composition directly to the recyclable aggregate as it is produced via the planing cutter 138. Thus, the natural agitation of the recyclable aggregate through the action of the planing cutter 138 acts to mix the asphaltic composition with the recyclable aggregate thereby eliminating the need for a separate mixing assembly. In such a configuration, the reclaimer assembly 80 may be conveniently utilized for collecting the recyclable aggregate and asphalt composition mixture and depositing the mixture at a predetermined position relative to the planer apparatus 40. Thereafter, the mixture may either be transported to a paving site or left in place for spreading and compacting by auxiliary machines.

In view of the large quantities of asphaltic composition consumed during the application thereof to the recyclable aggregate via the spray assembly 205, it may be desirable to augment the existing storage capacity of the planer apparatus 40 by providing a self-propelled storage vehicle 334 (see FIGS. 2 and 3) for supplying the asphaltic composition via a connecting conduit 336. Similarly, if desired, the storage vehicle 334 may be utilized as the exclusive source of the asphaltic composition to the exclusion of any supply tanks (not shown) normally provided on the planer apparatus 40.

Although the method and apparatus of the present invention have been described herein as utilizing only the material cut by the planer assembly 68*a* above the cutting plane in the production of new paving material, it will be readily recognized that additional new paving material may be easily furrowed in a conventional manner forwardly of the planer apparatus 40*a* with such additional material being automatically combined with the recyclable aggregate for processing by the asphalt paving assembly 300. In addition, other changes may be made in the construction and the arrangement of the various parts or elements of the apparatus, or of the steps of the method of the invention disclosed herein, without departing from the spirit and scope of the invention as defined in the following claims.

What is claimed is:

1. A method for resurfacing an existing paved roadway to produce a new roadway surface having a predetermined grade and cross slope, wherein the existing paved roadway has at least one irregular depression therein extending below the predetermined grade, the method comprising the stpes of:

removing the material of the paved roadway within a predetermined distance of the depression to a predetermined depth below the bottom of the depression;

applying a substantially uniform layer of new pavement material within the depression, the layer having an upper surface above the predetermined grade and a density substantially the same as the density of the existing pavement material surrounding the depression; and, passing a rotating planing cutter over the paved roadway at the predetermined grade and cross slope to remove the material of the paved roadway above the predetermined grade and cross slope.

2. A method for resurfacing an existing paved roadway of the asphalt type to produce a new roadway surface, the method comprising the steps of:

passing a rotating planing cutter over the paved roadway to cut the top portion of the paved roadway to a predetermined grade and cross slope in a full offset pattern having laterally adjacent cutting paths longitudinally offset on the order of one full length of each path; and, passing a fixed moldboard over the paved roadway at the predetermined cross slope and at a second predetermined grade slightly above the predetermined grade to remove the material of the paved roadway above the second predeterminddd grade and the predetermined cross slope.

* * * * *